United States Patent [19]

Graham et al.

[11] Patent Number: 4,722,782

[45] Date of Patent: Feb. 2, 1988

[54] METHOD FOR SOLVENT TREATING OF TAR SANDS WITH WATER DISPLACEMENT

[75] Inventors: Robert J. Graham, Lisle; John J. Helstrom, Naperville; Lawrence B. Peck, Glen Ellyn; Richard A. Stone, Yorkville, all of Ill.

[73] Assignee: Standard Oil Company, Chicago, Ill.

[21] Appl. No.: 546,828

[22] Filed: Oct. 31, 1983

[51] Int. Cl.[4] ..... C10G 1/04

[52] U.S. Cl. ..... 208/390

[58] Field of Search ..... 208/11 LE, 8 LE, 390

[56] References Cited

U.S. PATENT DOCUMENTS

| | | | |
|---|---|---|---|
| 2,871,180 | 1/1959 | Lowman, Jr. et al. | 208/11 LE |
| 2,980,600 | 4/1961 | Kelly | 208/11 LE |
| 3,459,653 | 8/1969 | Benson | 208/11 LE |
| 3,875,046 | 4/1975 | Rosenbloom | 208/11 LE |
| 4,036,732 | 7/1977 | Irani et al. | 208/11 LE |

FOREIGN PATENT DOCUMENTS

| | | | |
|---|---|---|---|
| 197810 | 10/1978 | United Kingdom | 208/11 LE |

*Primary Examiner*—Andrew H. Metz
*Assistant Examiner*—Chung K. Pak
*Attorney, Agent, or Firm*—John B. Goodman; William H. Magidson; Ralph C. Medhurst

[57] ABSTRACT

A method for the recovery of bitumen from tar sand comprises slurrying tar sand with about 0.5 to about 4.0 pound of a organic solvent per pound of tar sand, then adding greater than about 0.50 pound water per pound of tar sand, and separating a bitumen rich solvent phase. The method has the advantage of permitting separation of sand from the bitumen rich solvent extract without formation of a stable emulsion.

5 Claims, 2 Drawing Figures

METHOD FOR SOLVENT TREATING OF TAR SANDS WITH WATER DISPLACEMENT

This invention relates to a method of removing bitumen from tar sands. More particularly this invention relates to a method of removing bitumen from tar sands by solvent extraction accompanied by a water displacement to separate sand and water from the solvent-tar phase wherein greater than about 0.50 pound of water per pound of tar sand is mixed with a tar sands and solvent slurry at elevated temperature and a bitumen solvent phase and spent sand water phase are separated.

Large deposits of bitumen containing sand (tar sand) are found in various places throughout the world and vary considerably in composition and property. Some deposits are relatively soft and free flowing while others are very hard or rock like. The tar or bitumen content of these tar sands may vary over a wide range and presents an attractive source of supply of crude petroleum. For example, one very large deposit of tar sands is that in the Athabasca district of Alberta, Canada.

Various methods have been proposed in the past for recovery of bitumen from these tar sands but none of these methods has been entirely successful economically, because tar sands suffer the disadvantage of requiring additional processing steps compared to conventional forms of oil recovery. Therefore to prove commercially feasible, any tar sands extraction method must be price competitive with other petroleum sources.

One proposed method to recover bitumen from tar sands mixes tar sands with hot water and separates the sand from the formed mixture. This method suffers because of formation of an emulsion which is very difficult to break, thereby resulting in considerable loss of product, and because of use of large volumes of water. Other methods utilize solvent extraction which has the disadvantage of difficult separation of sand from the solvent extract phase. Still other methods use multisolvent systems wherein the tar sand is subjected to a series of solvents before it is finally recovered, which also exhibit the sand separation problem.

Some methods have combined solvent and water processing of tar sands. For example, U.S. Pat. No. 4,229,281, Alquist et al., "Process for Extracting Bitumen from Tar Sands", issued Oct. 21, 1980, discloses a method for the removal of sand fines generated during the solvent extraction of bitumen from tar sands. In this method a solvent solution of bitumen which has been separated from spent sand is contacted with an aqueous solution of cationic surfactant to effect the removal of sand fines from the solution.

U.S. Pat. No. 4,342,639, Gagon, "Process to Separate Bituminous Material from Sand (Tar Sands)", issued Aug. 3, 1982, discloses a method for treating tar sand with a halogenated organic solvent having a density greater than water to extract bitumen. The halogenated organic solvent containing the dissolved bitumen and bitumen depleted sand is continuously transferred to a conveyor system partially submerged in water. As the sands move through the water on the conveyor, the organic solvent containing the bitumen separates from the sand and forms a separate phase beneath the water. The depleted sands ultimately are moved upward on the conveyor for removal from the water.

European Patent Application No. 81305751.0, "Process and Apparatus for Extracting Bitumen Oil from Bitumen Containing Material", Rendall, published June 15, 1983, discloses forming a slurry of solvent, tar sand and hot water while excluding substantially all air therefrom to greatly reduce formation of emulsions of fine particles, water, bitumen and air. By sparging the formed slurry with steam, the slurry is then separated into an upper bitumen extract phase, a middle water and sand phase and a lower damp sand phase. Each of these phases is thereafter processed to produce bitumen, recovered solvent, water, and spent sand.

U.S. Pat. No. 3,459,653, Benson, "Filtration of Solvent-Water Extracted Tar Sand", issued Aug. 5, 1969, discloses a method for removing tar from tar sands comprising slurrying tar sands and solvent in the presence of about 1 to about 7 percent water by weight of tar sand, and then filtering the slurry through a bed of tar sands to produce a tar rich solvent filtrate. The water maintains an easily filtered slurry through control of sand fines.

None of the combination solvent and water extraction methods have focused on reducing the amount of solvent required to extract the bitumen from tar sands. None have disclosed displacement with water of a bitumen rich extracting solvent phase from bitumen depleted sand. Finally none have suggested adding about one void volume of water to a slurry of the solvent and tar sand to reduce the amount of solvent used and to perform a separation of bitumen depleted sand from the bitumen rich solvent phase while minimizing emulsion formation.

Therefore, it is an object of the invention to provide an improved method for the recovery of bitumen using solvent extraction and water displacement of tar rich solvent from tar depleted sand. Another object is to minimize emulsion formation during separation of the bitumen extract phase. Still another object is to reduce the amount of energy used in drying spent sand.

SUMMARY OF THE INVENTION

This invention relates to an improved method for treating tar sand comprising mixing tar sand, organic solvent and a displacing amount of water greater than about 0.50 pound water per pound of tar sand at a temperature of about 100° F. to about the azeotropic boiling temperature of the water and solvent to form a mixture comprising bitumen rich solvent, bitumen depleted sand and water; separating bitumen rich solvent from the mixture to leave a water and bitumen depleted sand slurry containing residual amounts of solvent; and separating bitumen from the bitumen rich solvent.

Adding greater than about 0.50 lb. water per lb. tar sand to a solvent tar sand slurry has the advantage of displacing the bitumen rich solvent extract phase from the bitumen depleted sand with minimal emulsion formation during the separation. A further advantage of water displacement is that recovery of the solvent for reuse requires less energy because of the displacement of solvent from the sand. Moreover, this amount of water agglomerates fines during the sand separation and can reduce the amount of fines in the solvent bitumen phase.

DETAILED DESCRIPTION OF THE INVENTION

The invention comprises a method for separating spent tar sand which has been substantially depleted of its bitumen tar content from a dissolved bitumen-solvent phase by a displacement with water, wherein formation of an emulsion of solvent, sand and water is minimized. The water displacement transfers spent sand from the bitumen-rich solvent phase to the water phase from which it is more easily separated, for example, by filtration, while concomitantly displacing adsorbed solvent from the spent sand. Further, Applicants have found that the water displacement of spent sand from the solvent phase and of solvent from the spent sand occurs without substantial emulsion formation. Thus the invention broadly comprises contacting a tar sand solvent slurry with a displacing water phase under conditions sufficient to transfer a substantial part of the spent sand into the water phase and to separate a solvent phase from the water phase without subtantial emulsion formation.

The water displacement involves mixing the displacing water phase with the solvent tar sand slurry and separating the bitumen solvent phase from the spent sand water phase. Mixing is needed to transfer the spent sand from the solvent phase to the water phase and to desorb solvent from the spent sand. The separating permits additional processing for recovery of bitumen for retorting, solvent and water for reuse, and spent sand for disposal. The mixing and separation are preferably performed in separate stages and at a temperature of about 100° F. to about 5° F. below the azeotropic boiling point of water and the solvent. Thus, for example, the solvent tar sand slurry is mixed with the displacing water with an in-line mixer and the resulting mixture is sent to a separating vessel for gravity separation.

Figure 1:
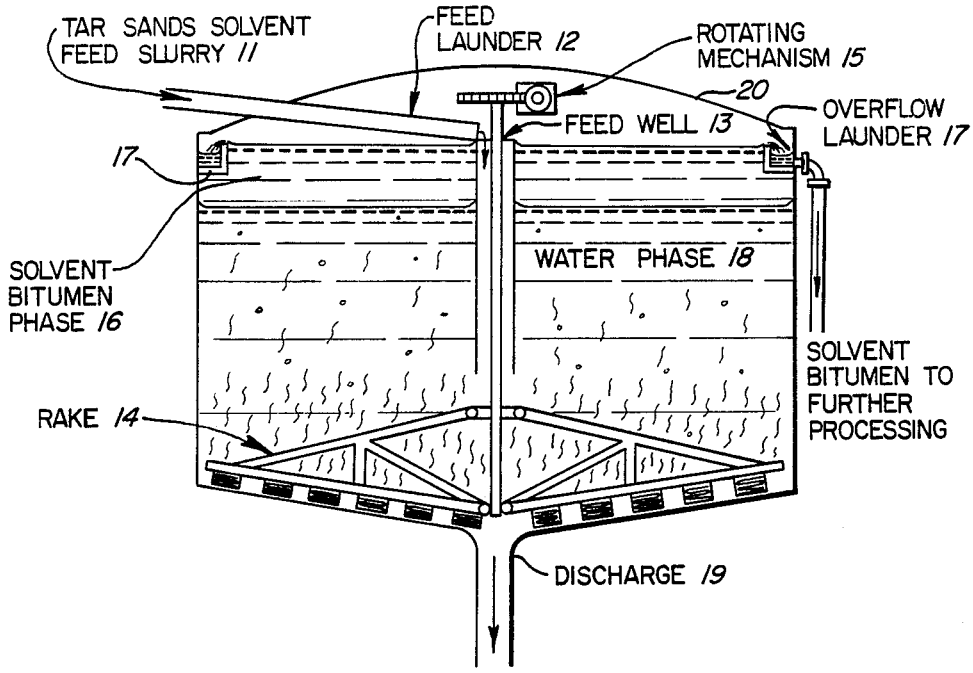
FIG. 1 illustrates a separating vessel used in the water displacement of the invention.

In one aspect of the invention, the displacement is performed by adding water to the solvent tar sand slurry and charging the resulting mixture to a separating vessel such as that depicted in FIG. 1 to achieve a continuous separation of the solvent phase. In another aspect, the invention comprises contacting tar sands with greater than about 1.0 lb. of a hydrocarbon solvent per lb. of tar sand; adding greater than about 0.50 lb. water per lb. tar sand to the solvent tar sand slurry to produce a dissolved bitumen solvent phase and a spent sand water phase containing residual amounts of solvent; separating the bitumen solvent phase from the spent sand water phase; stripping residual solvent from the spent sand water phase; separating spent sand from the spent sand water phase; and recovering bitumen from the bitumen solvent phase. In another aspect, the bitumen solvent phase after its separation is treated to remove sand fines.

The method of the invention can be used with the solvent extraction of bitumen from tar sands removed from many different deposits. In general, the tar sand treated contains about 5 to about 25 weight percent bitumen and less than about 15% water, and is crushed, broken or ground into a proper size for solvent extraction, which is preferably about ½ inch or less top size.

The extraction solvent is an organic compound which is substantially insoluble in water and is preferably designed to dissolve substantially all of the bitumen in the tar sand. The solvent can be unsubstituted or substituted by at least one halogen, oxygen, nitrogen or sulfur atom and has from 1 to 15 carbon atoms. Useful solvents include parrafinic hydrocarbons such as n-butane; methyl and dimethyl butane; n-pentane; n-hexane; n-heptane, n-octane; and methyl, ethyl, dimethyl and trimethyl pentanes, hexanes, heptanes and octanes; cyclohexane; aromatic hydrocarbons such as benzene, toluene and the xylenes; methyl ether; ethyl ether; methylethylether; the halogenated derivatives of any of these; and mixtures of any of the aforementioned. The solvent is preferably an unsubstituted hydrocarbon with 4 to 9 carbon atoms, and more preferably with 6 to 8 carbon atoms. A preferred solvent is n-heptane or a narrow range of hydrocarbons boiling around the boiling point of n-heptane, for example, commercial heptane. Heptane is preferred because it is a good solvent with a low density viscosity, and boiling point.

Because of varying solubilities in different solvents of the asphaltene content of the bitumen, the solvent can be selected to have have a solubility power which will leave undissolved about 5 to about 25 weight percent of the tar. Use of such a solvent can be advantageous because this amount of undissolved asphaltenes agglomerates and removes sand fines from the solvent phase. The selection of such a solvent to leave undissolved asphaltenes to agglomerate fines is disclosed in Ser. No. 449,607, "Recovery of a Carbonaceous Liquid of Low Fines Content," Peck, filed Dec. 14, 1982 and herein incorporated by reference. When using this type of solvent, the amount of solvent used is about 0.20 to about 1.0 per lb. of tar sand. For example, a mixture of 35 volume % commercial heptane and 65 volume % n-pentane can be used in this manner.

The displacing water phase advantageously does not require additives, such as a surfactant or a base, which increase the cost of a tar sands process. The amount of displacing water used includes the amount of water present initially in the tar sands, which is generally below about 15%. Thus, the amount of displacing water phase used includes the amount present in the tar sand plus additional water to reach the desired amount. One void volume of displacing water is that amount sufficient to fill the voids between the sand grains of the tar sand after the tar sand has been reduced in size, and is about 0.20 to about 0.50 lb. water per lb. tar sand. The lb. tar sand used herein is measured before bitumen extraction. The amount of displacing water phase added to the slurry of tar rich solvent and bitumen depleted sand can be greater than about 0.20 lb. water per lb. tar sand, or within about 0.20 to about 0.50 lb. water per lb. of tar sand, or larger amounts than 0.50 lb. water per lb. tar sand, for example, greater than about 1.0 lb. per lb. of tar sand. The advantage of these displacing amounts is that they displace solvent from spent sand and spent sand from solvent while minimizing formation of a stable emulsion during phase separation.

The amount of solvent used depends on the amount of displacing water phase used. Where more than 0.50 lb. water per lb. of tar sand is used, the solvent to tar sand ratio is about 0.5 lb. solvent/lb. tar sand to about 4.0 lb. solvent/lb. tar sand. Where about 0.20 to about 0.50 lb. water is used, the solvent amount is preferably about 0.20 to about 0.40 lb. per lb. tar sand, although larger amounts can be used. Thus, one advantage of displacement with about one void volume of water is that it reduces solvent usage.

The apparatus preferred as a separating vessel in the water displacement is a conventional thickener shown in FIG. 1. The separating vessel is designed to have a residence time greater than about 30 seconds, preferably below about 10 minutes, and more preferably about 2½ minutes. In the separating vessel additional mixing of the phases occurs and the solvent and water phases are gravity separated on a continuous basis.

The slurry 11 of water, bitumen-rich solvent, and bitumen depleted sand is fed into tank 20 by feed launder 12 to central feed well 13. A powerful rake 14 is rotated by rotating mechanism 15 through the slurry, and the bitumen-rich solvent phase 16 floats to the top and into overflow launders 17. The overflow is sent for further processing to recover the bitumen. The rake 14 sweeps water and bitumen depleted sand phase 18 containing residual amounts of solvent to a central discharge 19 at the bottom of the tank. The thickener is not provided with a means for injecting a sparging gas, such as steam, because the separation in the water displacement is performed without needing a sparging gas. A thickener like that shown in FIG. 1 is available from Envirotech and other companies and is of proven operability. A water displacement performed in such a separating vessel has the advantage of separating the solvent phase from the water phase without substantial emulsion formation concomitantly with sand removal from the solvent phase and solvent removal from the sand. The apparatus used in the other processing steps of the invention are known to those skilled in the art.

The processing steps are now described in more detail. The process steps of the invention are better performed while excluding air, although all can be done withou such measures. For safety reasons, it is preferred to perform the solvent extraction and the water displacement in the absence of oxygen or air since the solvents used are flammable, the solvent extraction works best at elevated temperatures, and moving equipment creates a risk of sparking.

The solvent and tar sand can be mixed together in any manner desired to form the slurry of solvent and tar sand which comprises bitumen rich solvent and bitumen depleted sand. However, it is preferred to contact the solvent with the tar sand by autogenous grinding or crushing of the tar sand in the presence of solvent. This technique is preferred because the solvent prevents crushed tar sand from sticking since the gummy bitumen dissolves in the solvent, and because it eliminates a separate solvent tar sand contacting stage.

Three ways to add the displacing water phase to the solvent and tar sand slurry are: (1) forming the mixture of the solvent, tar sand and water simultaneously; (2) forming the tar sand and solvent slurry and then adding water before introduction into the separating vessel; and (3) feeding the solvent tar sand slurry into the separating vessel filled with the desired amount of water. It is preferred to use (2) because better solvent tar sand contacting and better mixing of the water with the solvent/tar sand occurs.

The temperature of the solvent tar sand contacting is conventional and known to those skilled in the art. The temperature at which the water displacement is performed depends on the amount of displacing water phase used. Where greater than about 0.50 lb. water/lb. tar sand is used, the temperature during mixing and in the separating vessel is about 100° F. to about 5° F. below the azeotropic boiling temperature for water and the particular solvent used. Where about 0.20 to about 0.50 lb. $H_2O$/lb. tar sand is used, the temperature is about 80° F. to about 5° F. below the azeotropic temperature, and preferably about 100° F. to about 5° F. below the azeotropic temperature. Temperatures above 100° F. are preferred because of faster phase separation and because of the potentially explosive nature of the solvent—higher temperatures ensure a hydrocarbon atmosphere without air present. Temperatures higher than the atmospheric azeotropic boiling temperature can be used with any amount of displacing water but are not desirable due to the high cost of pressure vessels. After mixing at the above temperatures, the separation can also be made by settling at the above temperature and then additional settling during cooling.

After the bitumen solvent phase and spent sand water phase are separated, both are treated further. The spent sand water phase contains a residual amount of solvent adsorbed to the spent sand which can be recovered. The residual solvent is preferably recovered by stripping with steam, for example, in a rotary kiln or packed column. The stripping is preferably performed in a column packed with a suitable packing such as, for example, that used in the removal of $SO_2$ from a gas by countercurrent contact with a lime slurry. Thus, the spent sand water phase is flowed down the packed column with steam injected from the bottom. The condensate taken off the top of the column contains desorbed solvent and water, and is easily separated. A clean spent sand and water slurry is taken from the column bottom. The spent sand is then separated from the water by suitable means, for example, filtering. Because of the removal of the solvent from the spent sand by the water displacement and stripping, the filter used does not require a more expensive solvent tight cover.

In addition to steam stripping to remove solvent, the spent sand can be treated by another stage of water displacement to desorb and float solvent from the sand. For example, the spent sand and water phase is mixed with more water and is sent to another thickener where the upper solvent phase is again separated.

The bitumen solvent phase is separated to produce product bitumen and solvent for reuse of methods known to one skilled in the art, for example, by evaporative drying. Because the water displacement with about one void volume of water lowers solvent usage, the evaporation does not need as much energy as in other solvent extraction processes. The product bitumen contains some sand fines and is upgraded into saleable products by retorting or hydroprocessing. If desired, the fines content of the bitumen can be reduced, for example, by a deasphaltening method.

The deasphaltening method of fine removal is described in copending application Ser. No. 459,182, Wolff et al, filed Jan. 19, 1983, herein incorporated by reference. In this deasphaltening method, the bitumen rich solvent phase containing fines is fed into a thickener similar to the thickener 23 or other mixer/settling tank and is contacted with a solvent of limited solubility for asphaltenes. A portion of the asphaltene content of the bitumen precipitates, and settles and agglomerates the fine sand particles to lower the fine content of the tar rich solvent phase. The bitumen rich solvent phase after the asphaltene and fine removal is then sent to dryers for evaporation and recovery of the solvent and the bitumen. The bitumen can be retorted in a conventional fashion.

Figure 2:
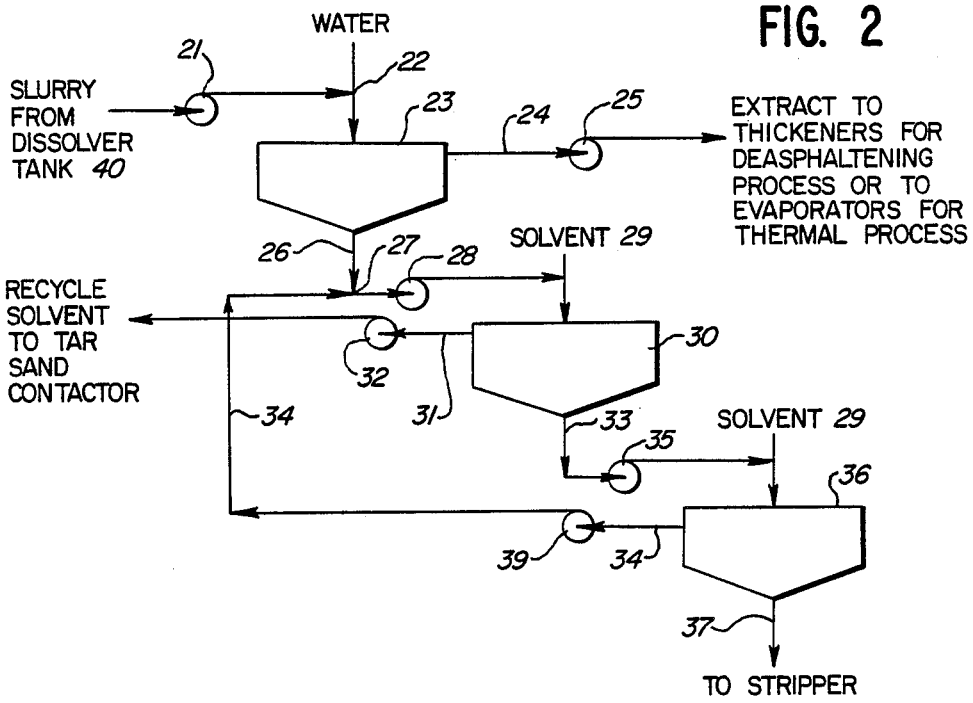
FIG. 2 illustrates a detailed processing method of the invention.

A preferred aspect of the invention is best described by reference to FIG. 2 which shows a schematic flow diagram of the invention. A bitumen rich solvent and spent sand slurry 20 containing about 0.20 to about 0.40 lb. solvent/lb. tar sand is sent by pump 21, combined at 22 with about 0.20 to about 0.50 pound water per pound of tar sand by an in line mixer, and fed to thickener 23, described above. In the thickener the bitumen solvent phase floats to the top, overflows into launders on the sides of the thickener and drains from the launders through line 24 to the overflow pump 25. The bitumen rich solvent overflow is then sent to other thickeners or centrifuges for removal of fines or to evaporators to remove solvent and produce bitumen for upgrading into saleable products, for example, by retorting or hydroprocessing.

The underflow 26 containing mainly water and bitumen depleted sand with some residual solvent is combined at 27 with an overflow 34 from a third thickener 36 which consist mainly of solvent and is sent through pump 28 to thickener 30. Additional solvent 29 plus solvent in recycle 34 in an amount of about 0.20 to about 0.40 pound solvent per pound tar sand is added to the underflow stream. In the thickener 30 a bitumen solvent phase floats to the surface and is removed through line 31 and pump 32 and returned to the tar sand-solvent contacting tank, not shown.

The underflow 33 containing mainly water and spent sand is sent through pump 35, is repulped with an additional about 0.20 to about 0.40 pound solvent per pound tar sand, and is fed to thickener 36 for further bitumen recovery. In this thickener an overflow 38 containing mainly solvent is removed from the launders as described above and is sent through pump 39 as stream 34 for combining with the underflow 26 from thickener 23. The underflow 37 from thickener 36 is a water and spent sand phases containing small amounts of adsorbed residual solvent and is sent to a steam stripper for solvent recovery.

The following examples illustrate the water displacement of spent sand from the bitumen rich solvent phase while separating the spent sand water phase from the bitumen solvent phase.

EXAMPLES 1-5

In these examples, tar sand from Sunnyside, Utah and solvent were thoroughly mixed for about ½ hour at room temperature, and any solvent loss was replaced. Water was added and the slurry stirred at 750 rpm at a temperature of about 175° F. for about 2 hours; the heating was done at atmospheric pressure with a reflux condenser on the slurry container. The sand was allowed to settle for 1 hour at 175° F. and 1 hour while cooling, and the solvent phase was decanted. The solvent was evaporated and the bitumen yield determined. The sand was filtered from the water phase and analyzed. The solvent used, solvent/tar sand and water/tar sand ratios on a weight basis, bitumen (tar) content by weight percent in the solvent phase, ash content by weight % in the recovered bitumen, and organic residue by weight % in the dried sand are shown in Table I.

TABLE I

| Example | Solvent | Solv/Sand | Water/Sand | Tar in Solvent | Ash | Organic Residue |
|---|---|---|---|---|---|---|
| 1 | 9% Cyclo-$C_6$ 91% n-$C_6$ | 1.1 | 2.0 | 7.0 | 2.3 | 0.25 |
| 2 | 9% Cyclo-$C_6$ 91% n-$C_6$ | 1.1 | 2.0 | 13.5 | 13.2 | 0.15 |
| 3 | 20% Cyclo-$C_6$ 80% n-$C_6$ | 1.0 | 2.0 | 7.0 | 2.5 | — |
| 4 | 30% Cyclo-$C_6$ 70% n-$C_6$ | 1.0 | 2.0 | 7.0 | 17.1 | 0.24 |

TABLE I-continued

| Example | Solvent | Solv/Sand | Water/Sand | Tar in Solvent | Ash | Organic Residue |
|---|---|---|---|---|---|---|
| 5 | Toluene | 1.0 | 2.0 | 7.0 | 23.4 | 0.23 |

As seen in the organic residue in the sand, the solvent phase was substantially displaced from the sand by a displacing water phase of 2.0 lb per lb sand at elevated temperatures with mixing. Moreover, no substantial emulsion formation was present during the settling; the emulsion present during mixing dissipated quickly.

EXAMPLES 6-14

Examples 6-14 illustrate reduction of the amounts of solvent used in a tar sands extraction method when used in combination with a water displacement using about 1 void volume of water. These examples simulated the method of FIG. 2. The thickener was a 3.75 inch diameter by 34½ inch high glass tube with a water jacket on the lower 29½ inches. The temperature of the tube was controlled by hot water circulating through the water jacket. Slurries were stirred in the thickener by a 3¼ inch diameter by a 30 inch long rake driven by a ⅛ horsepower motor.

Prior to addition to the solvent/sand/water slurry into the thickener tube, the solvent and sand slurry was mixed in an 8¼ inch diameter by 13½ high glass battery jar. Water was then added using a mixer with a shaft speed of 300 RPM.

The procedure used six cycles:

Cycle I - Thickener 23

4,000 grams of tar sands from Sunnyside, Utah, were mixed with 800 grams of n-heptane (or other solvent as indicated) with a spatula in the battery jar for 15 minutes. Both the solvent and tar sand were preheated to 145° F. and the battery jar was in a 145° F. water bath during mixing. Solvent lost through evaporation was replaced at the end of the mixing. A thousand grams of distilled water were added to the tar sand solvent slurry and mixed 2 minutes at 145° F. The resulting slurry was then poured rapidly into the thickener tube and settled for 2½ minutes at 145° F. The thickener rake was turned at 2 RPM throughout the settling. After 2½ minutes the heights of the solvent-bitumen layer and the water-sand layer were recorded. The solvent bitumen layer was removed by vacuum, and the water sand layer was dumped back into the battery jar. Both the solvent bitumen layer and the water sand layer were weighed. The thickener tube was weighted to determine the weight of residue in the tube. The solvent bitumen layer was analyzed for bitumen, sand, water and solvent.

Cycle II - Thickener 30

To simulate the operation of thickener 30,800 grams of n-heptane (or other solvent as indicated) were added to the water sand layer from Cycle I and the slurry was mixed for 5 minutes at 145° F. Solvent losses from evaporation were replaced at the end of the mix period. The resulting slurry was poured into the thickener tube and settled for 2½ minutes. The rake was turned at 2 RPM. The heights of the solvent bitumen layer and the water sand layer were recorded. The solvent bitumen layer was removed by vacuum and weighed and analyzed. The water sand layer was weighed and returned to the thickener tube.

Cycle III - Thickener 36

To simulate the operation of thickener 36, the water sand layer resulting from Cycle II was mixed with 800 grams of n-heptane (or other appropriate solvent) and mixed for 5 minutes at 145° F. Solvent losses were replaced. The above steps of pouring into the thickener tube, settling for 2½ minutes with the rake revolving at 2 RPM were repeated. The solvent layer was removed by vacuum weighed and analyzed. The water sand layer was weighed and analyzed for bitumen, sand, water and solvent.

Cycle IV - Recycle Streams 31

To simulate the use of recycle streams 31 and 34, a second stage of three thickener operations, Cycles IV–VI, were performed. A fresh 4000 gr. of Sunnyside tar sands was mixed with the solvent overflow from Cycle II above, stream 31, and was mixed as above. Evaporation losses were replaced by fresh solvent. The settling and overflow removal were repeated. The solvent bitumen overflow layer was analyzed for bitumen, sand, water and solvent.

Cycle V - Recycle 34

Cycle II was repeated using the water sand layer underflow from Cycle IV, stream 26, and the solvent bitumen layer from Cycle III, stream 34. The mixing, settling, and overflow removal were repeated. The solvent bitumen layer produced from the thickener was analyzed for bitumen, sand, water and solvent.

Cycle VI - Thickener 36

Cycle III was repeated using the water sand layer from Cycle IV stream 33, and fresh solvent. The mixing, settling and removal were repeated. The bitumen solvent layer and the water sand layer were analyzed for bitumen, sand, water and solvent. The overflow corresponds to stream 34 and the underflow corresponds to stream 37.

Table II illustrates the data from Examples 6 through 14 which were seven runs with n-heptane, 1 run with n-hexane, and 1 with cyclohexane. Shown are the solvent, % bitumen in the tar sand, the water to tar sand ratio, the solvent to tar sand ratio, the bitumen recovery, the sand on a weight basis in the solvent extract, the water on a weight basis in the solvent extract, and the solvent on a weight basis in the spent sand tailings.

TABLE II

| Example | Solvent | Wt. % Tar | Wt. $H_2O$ / Wt. Tar Sand | Wt. Solvent / Wt. Tar Sand |
|---|---|---|---|---|
| 6 | n-$C_7$ | 6.62 | 0.20 | 0.15 |
| 7 | " | 6.47 | 0.20 | 0.25 |
| 8 | " | 6.38 | 0.30 | 0.15 |
| 9 | " | 6.74 | 0.30 | 0.25 |
| 10 | " | 6.50 | 0.25 | 0.20 |
| 11 | " | 6.68 | 0.25 | 0.20 |
| 12 | " | — | 0.25 | 0.20 |
| 13 | n-$C_6$ | 6.31 | 0.25 | 0.20 |
| 14 | cyclo-$C_6$ | 6.86 | 0.25 | 0.23 |

| Example | Tar Recovery in Extract (%) | Sand In Extract[a] | $H_2O$ in Extract[a] | Solvent in Tailings (Wt. %) |
|---|---|---|---|---|
| 6 | 88.55 | 0.531 | 0.111 | 5.35 |
| 7 | 95.67 | 0.614 | 0.060 | 4.45 |
| 8 | 73.90 | 0.655 | 0.140 | 6.44 |
| 9 | 94.25 | 0.729 | 0.091 | 4.93 |
| 10 | 93.89 | 0.695 | 0.111 | 4.61 |
| 11[b] | 94.15 | 0.632 | 0.10 | 4.77 |
| 12[c] | 94.29 | 0.433 | 0.091 | 3.86 |
| 13 | 93.23 | 0.946 | 0.074 | 4.49 |
| 14 | 92.96 | 0.587 | 0.089 | 6.28 |

[a]on a weight per weight tar basis
[b]5200 grams tar sand treated in Cycle 1 to increase height of water-sand phase 5".
[c]1600 grams tar sand treated in 2" diameter thickener without rake; only Cycles I–III performed.

The tar recovery was determined by dividing the weight of bitumen in the sand separated from Cycle VI by the weight of bitumen in the tar sand feed, and subtracting the quotient from 1. As is seen in the data, the bitumen recovery was above about 93% in all runs using a solvent/tar sand ratio of about 0.20 to about 0.25 and water/tar sand ratio of about 0.20 to about 0.30. The runs with a solvent/tar sand ratio of 0.15 had poorer recovery with higher solvent in the sand tailings. No significant emulsion formation was seen in any run.

Examples 10 and 11 illustrate that recovery is independent of the height of the water sand phase in the thickener. Example 11 with a taller water sand phase in fact showed slightly higher recovery.

EXAMPLE 15

To illustrate the use of the steam stripper, a slurry of spent sand, water and solvent were treated in a column. The column was 6 inch diameter, and packed with Munter's commercially available plastic packing. The feed slurry contained 56.28% sand, 3.52% heptane, and 40.2% water by weight, and was fed in near the top of the column. Superheated steam, 292° F. at 5 psi, was fed to the bottom of the column at 4.67 lb/min. The column was run at a steady rate for 18 minutes. The condensate contained 1.47 lbs/min heptane and 0.8 lbs/min water. The slurry taken from the bottom contained 33.76 lbs/min sand, 22.72 lbs/min. water, and 0.02 lbs/min solvent. Virtually all solvent was removed from the sand by the stripper.

The above discussion is intended to be merely illustrative. The full scope of the invention is given by the following claims.

We claim:

1. A method for the recovery of bitumen from tar sand comprising contacting the tar sand with about 0.5 to about 4.0 pound of a hydrocarbon solvent per pound of tar sand to form a slurry of bitumen rich solvent and bitumen depleted sand; adding greater than about 0.50 pound water per pound of tar sand to the slurry at a temperature of about 100° F. to about 5° F. below the azeotropic boiling temperature of water and solvent to form a mixture of bitumen rich solvent, bitumen depleted sand and water; introducing the mixture into a separating vessel; separating bitumen rich solvent from the mixture to leave a water and bitumen depleted sand slurry containing residual amounts of solvent; stripping residual solvent from the bitumen depleted sand; and separating bitumen from the bitumen rich solvent.

2. The method of claim 1 wherein the amount of water is greater than about 1.0 pound water per pound of tar sand.

3. The method of claim 1 wherein the hydrocarbon solvent is selected from the group consisting of paraffins of carbon number 4 to 9 and mixtures thereof.

4. The method of claim 1 wherein the hydrocarbon solvent is n-heptane or a mixture of paraffinic hydrocarbons boiling around the boiling point of n-heptane.

5. The method of claim 1 wherein the solvent is selected to dissolve substantially all of the bitumen in the tar sand.

* * * * *